United States Patent [19]

Rodgers, Jr.

[11] Patent Number: 4,844,450

[45] Date of Patent: Jul. 4, 1989

[54] SWIMMING SIMULATOR

[76] Inventor: Robert E. Rodgers, Jr., 8011 Meadowcroft, Houston, Tex. 77063

[21] Appl. No.: 150,207

[22] Filed: Jan. 29, 1988

[51] Int. Cl.[4] ..... A63B 31/00; A63B 21/22; A63B 21/00; A63B 69/10

[52] U.S. Cl. ..... 272/71; 272/128; 272/132; 434/254

[58] Field of Search ..... 272/70, 71, 72, 73, 272/97, 128, 130, 132, 144, 134; 128/25 R; 434/254

[56] References Cited

U.S. PATENT DOCUMENTS

| | | | |
|---|---|---|---|
| 326,247 | 9/1885 | Root | 272/71 |
| 770,994 | 9/1904 | White | 272/128 |
| 1,620,146 | 3/1927 | Walton | 272/71 |
| 2,013,520 | 9/1935 | McDermott | 272/71 |
| 3,810,614 | 5/1974 | Hessburg | 272/71 |
| 4,396,188 | 8/1983 | Dreissigacker et al. | 272/128 |
| 4,470,597 | 9/1984 | McFee | 272/128 |

FOREIGN PATENT DOCUMENTS

| | | | |
|---|---|---|---|
| 86/01420 | 3/1986 | PCT Int'l Appl. | 272/71 |
| 0961723 | 9/1982 | U.S.S.R. | 272/71 |

*Primary Examiner*—Richard J. Apley
*Assistant Examiner*—S. R. Crow
*Attorney, Agent, or Firm*—Gunn & Nichols

[57] ABSTRACT

An exercise device for simulated swimming strokes is disclosed. A cabinet supported on a frame serves as a base and has a body supporting platform thereabove, one portion supporting the torso and parallel duplicate hinge portions supporting the legs of the user. The user's arms reciprocate cable means and the user's legs reciprocate pivotal push rods extending into the cabinetry for rotating power consuming means comprising independent arm and leg powered fly wheels respectively connected to arm and leg powered means.

17 Claims, 3 Drawing Sheets

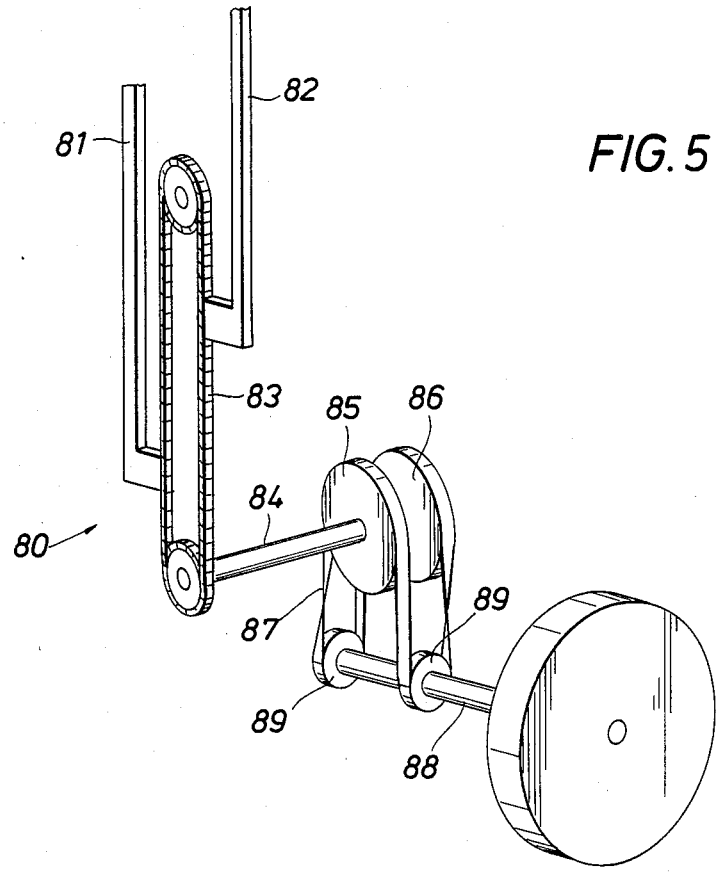
FIG. 5
FIG. 6
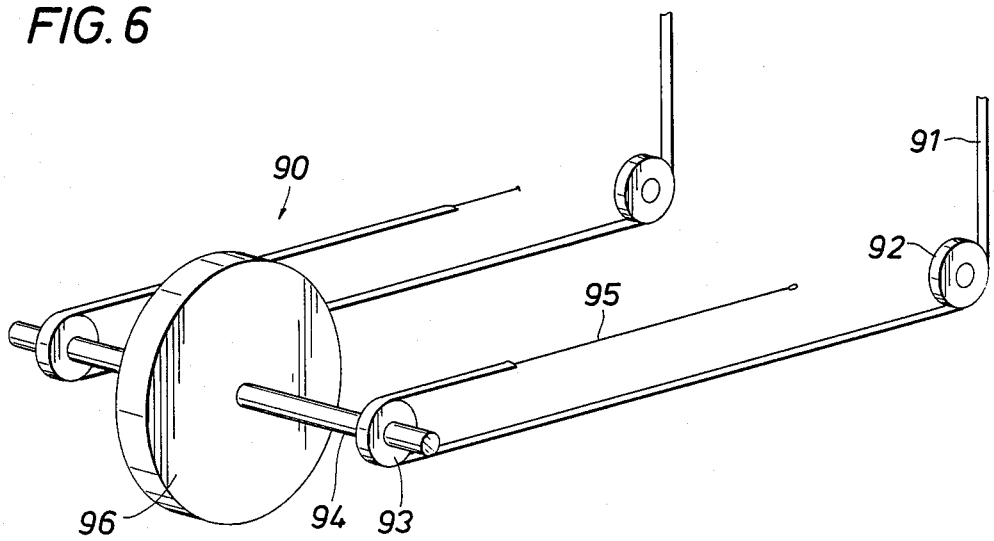

SWIMMING SIMULATOR

BACKGROUND OF THE DISCLOSURE

This apparatus is a swimming simulator to be used for training by a user out of a swimming pool and in particular which device permits a user to engage in a swimming stroke exercising the arms and legs. Moreover, left and right synchronization is not required so that the user can perform a simulated crawl stroke or simultaneous strokes such as a butterfly stroke.

Perhaps swimming is the most efficient and least injurious exercise form presently available. It is highly desirable in that it provides exercise to practically all muscle groups within the body. In another aspect, it is highly aerobic and able to provide a highly desirable cardiovascular exercise regime to a user without the risk of localized injuries found in other modes of exercise. It is more rapidly accomplished than brisk walking. Swimming is susceptible to fewer injuries than the more stressful exercise of jogging or running with the proportionate risk of knee or ankle injury as a result of pounding during running. Swimming additionally is more aptly effective throughout the body as opposed to bicycle riding which is primarily exercise on the legs. In all regards, swimming is more desirable in that it provides a higher and more distributed aerobic load to the user with reduced localized impact, and is desirable from all points of view for these factors. Swimming, however, requires physical competency and to some measure requires endurance training. Once the requisite skill has been developed by the user, then some measure of self-satisfaction can be achieved by the user in performing swimming strokes with a reasonable stroke efficiency. While the exercise level might be quite high with an inefficient stroke, the present apparatus is a swimming simulator which permits the user to develop strokes out of the swimming pool. Thus it finds use both as training device and also as a swimming simulator in the absence of a swimming pool or perhaps for use in indoor circumstances where the swimming pool is exposed to weather which might otherwise be inclement.

The present apparatus is intended as a training device to develop swimming skills for those who desire such competency, and also is a swimming training device to replace the more inconvenient access of a properly heated swimming pool or other facility not always available to the user. This device is a type of resistance system having certain structural and mechanical features as will be described.

One device is identified in U.S. Pat. No. 2,019,224 directed to an instruction device for teaching the crawl stroke which assures guidance wherein the hands of the swimmer pass through substantially vertical orbits on the sides of the body including forward extension, downward sweep and reaching from the end of the stroke back to the forward point of the stroke. This uses a closed or guided track way. It does not permit any other type of hand motion. Another type of synchronized hand motion is set forth in U.S. Pat. No. 326,247 directed to a hand crank driven mechanism. A full body exercise swimming system is shown also in U.S. Pat. No. 1,990,124. 1 An additional patent is U.S. Pat No. 2,033,275 showing hand powered rotary cranks in conjuction with a support frame. More recent patents are U.S. Pat. Nos. 3,731,921 and 3,810,614. A computerized system including arm and leg operated systems is revealed in U.S. Pat. No. 4,422,634. A cable operated hand powered energy absorbing exercise device is illustrated in U.S. Pat. No. 4,537,396. Independently gripped arms in conjunction with a support cable is disclosed in U.S. Pat. No. 4,674,740. While these and other devices suggest that others have considered such swimming machines, and similar exercise systems, it is submitted that they do not disclose a ystem wherein the legs are fully supported, the legs are powered with a variable power stroke of variable length, and the arms are permitted to operate independently so that they can be synchronized together or out of phase with one another to provide different strokes. The legs can power any length of stroke, often described as a scissor stroke.

The system of this disclosure is a balanced system in that power can be applied from the left or the right side of the user so that the power is applied as pulsating unidirectional power. The system also enables the height of each leg to be changed whereby the leg rest position and stroke length is varied. This present apparatus incorporates a cabinet to enclose the machinery of the equipment, and ideally, an air blower is located on the interior which can be ducted to provide air flow to the user. Pulsating power is delivered through the four limbs of the user through overrunning clutches to thereby enable the user to engage in a crawl stroke and then to separately switch to a butterfly or breast stroke. A full length structure is defined by the present apparatus for the user during operation, but the structure collapses to define a shorter more compact structure for ease of storage. The present apparatus thus defines a padded rest for supporting the torso of a user. It is appended to a pair of leg supports which pivot at the torso support. The range or stroke of pivotal movement is controlled. On each stroke, the user forces the leg support down which is then restored by movement in the upward direction. The arms of the user reach forward to grasp flexible cables connected to handles. This enables the user to indulge in a fully encircling simulated crawl stroke. Alternatively, the cables can be operated simultaneously by the user indulging in other simultaneous strokes including the butterfly stroke or other strokes wherein the arms reach laterally out from the body. Synchronized simultaneous operation by the arms is permitted, or the arms can be operated with 180° synchronization of movement typified by the crawl stroke.

BRIEF DESCRIPTION OF THE DRAWINGS

So that the manner in which the above recited features, advant and objects of this invention as well as others which will become apparent are attained and can be understood in detail, a more particular description of the invention, briefly summarized above, may be had by reference to the embodiments thereof that are illustrated in the appended drawings, which drawings form a part of this specification.

It is to be noted, however, that the appended drawings illustrate only typical embodiments of this invention and are therefore not to be considered limiting of its scope, for the invention may admit to other equally effective embodiments.

IN THE DRAWINGS

Figure 2:
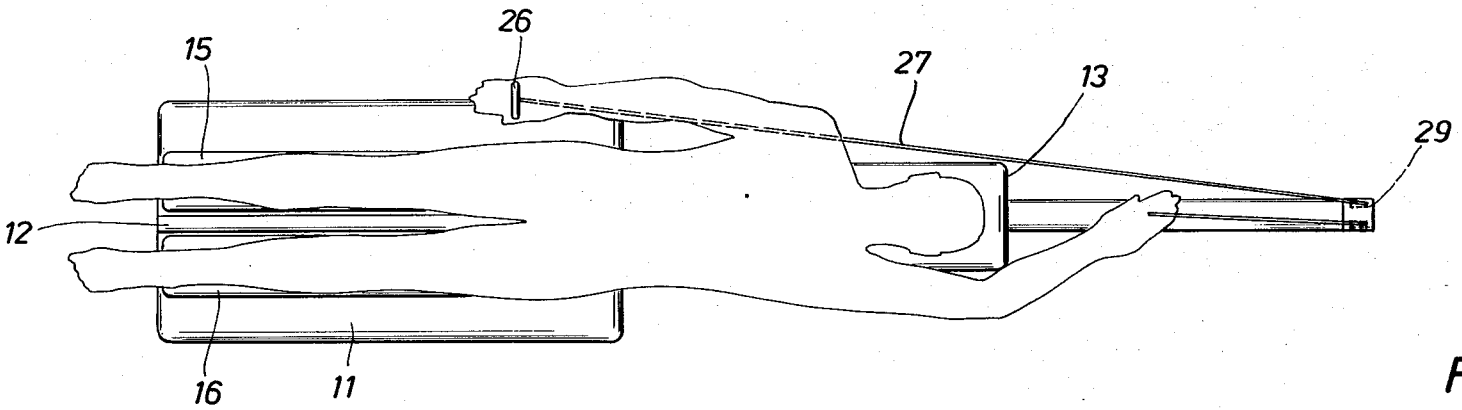
Figure 1:
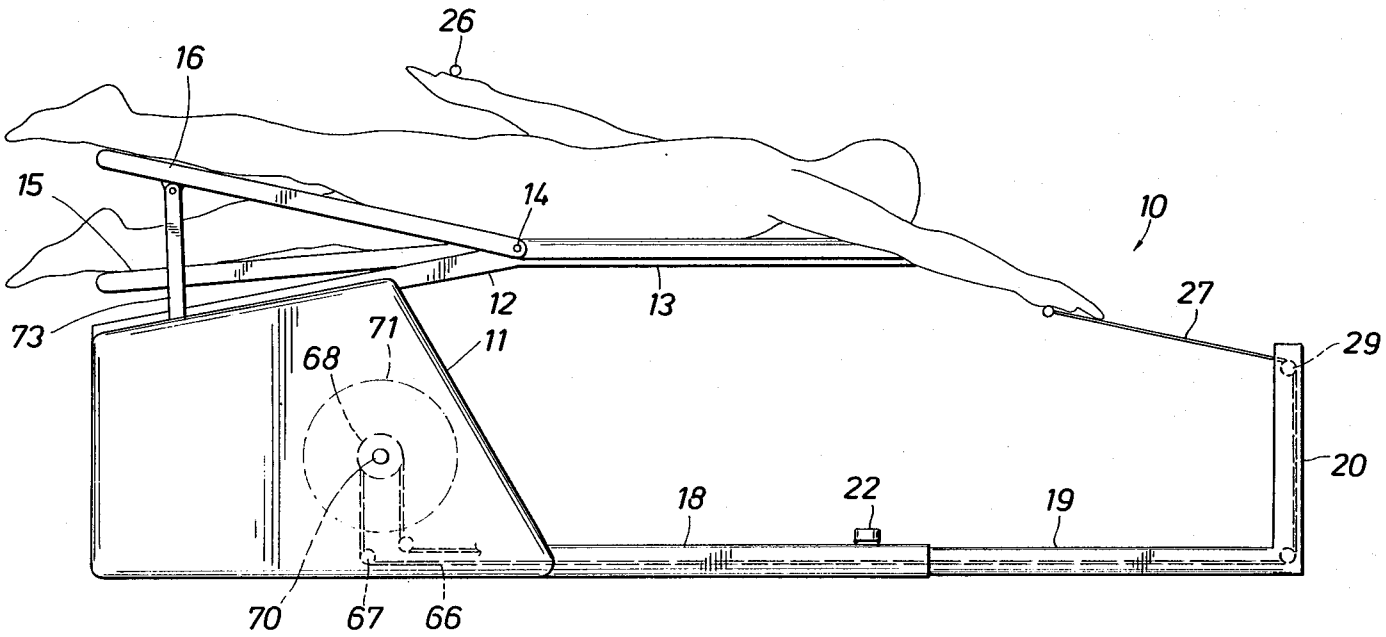

FIG. 1 is a side view of the apparatus of the present disclosure supporting a user thereon wherein the user is able to perform a simulated swimming stroke while exercising both arms and legs;

FIG. 2 is a plan view of the apparatus shown in FIG. 1 showing the position of the user on the apparatus;

FIG. 6 is a slightly modified mounting and cabling system for wise with the fly wheel in the present apparatus.

DESCRIPTION OF THE PREFERRED EMBODIMENT

In FIG. 1 of the drawings, the exercise apparatus of the present invention is identified generally by the numeral 10. This apparatus includes a cabinet or cowling 11 which encloses certain moving components as will be described. The cowling connects with a cantilevered support frame member 12 which extends upwardly and horizontally to support a body brace 13. It has an upper portion or top surface which is padded to support the torso of a user. It has a width which approximates that of the body but it does not extend so wide as to interfere with arm movement as shown in FIG. 2. Conveniently, the width is in the range of about 10–14 inches. As shown in FIG. 2, the brace 13 extends that the head also may rest on the brace. Appropriate padding is included so that the head and torso rest comfortably. Indeed, a pad beneath the forehead of the user in conjunction with suitable breathing holes and the like increases comfort. The brace 13 extends from beyond the head to a point in the region of the groin so that the legs are able to pivot downwardly and upwardly. The back end of the brace 13 connects at a suitable pivot 14 so that the legs of the user are supported by leg braces 15 and 16 The leg braces 15 and 16 are identical to one another and differ only in their location. They are both supported on the pivot 14. They are able to reciprocate upwardly and downwardly through a defined angle of deflection. Primarily, the torso of the user is carried by the brace 13 with the user horizontally comfortable on the padding or other cover on the surfaces.

The system is adapted to rest on a floor or other flat surface. The cowling 11 encloses the apparatus on the interior to be described. A hollow tubular member 18 extends forwardly from the cowling and telescopes with a tubular extension 19. This extension connects with an upstanding upright 20. All of the members just described are hollow to enclose certain flexible members as will be described. Moreover, a lock nut 22 threads through the wall of the tubular member 18 to lock against the tubular member 19 to fix in position. This locks the members in the extended position. If desired, the members 18 and 19 can be telescoped so that the equipment collapses and is thereby made shorter. When shorter, it is more readily stored. The equipment can be shortened from a typical length of about nine feet to perhaps six feet in length. In view of the fact that the width is not much wider than a person and typically in the range of about two feet, the device does not require excessive floor space for storage. Certain reaction forces are imposed on the tubular members so that the lock nut 20 must be fastened snugly and tightly to prevent any further movement during use.

Figure 3:
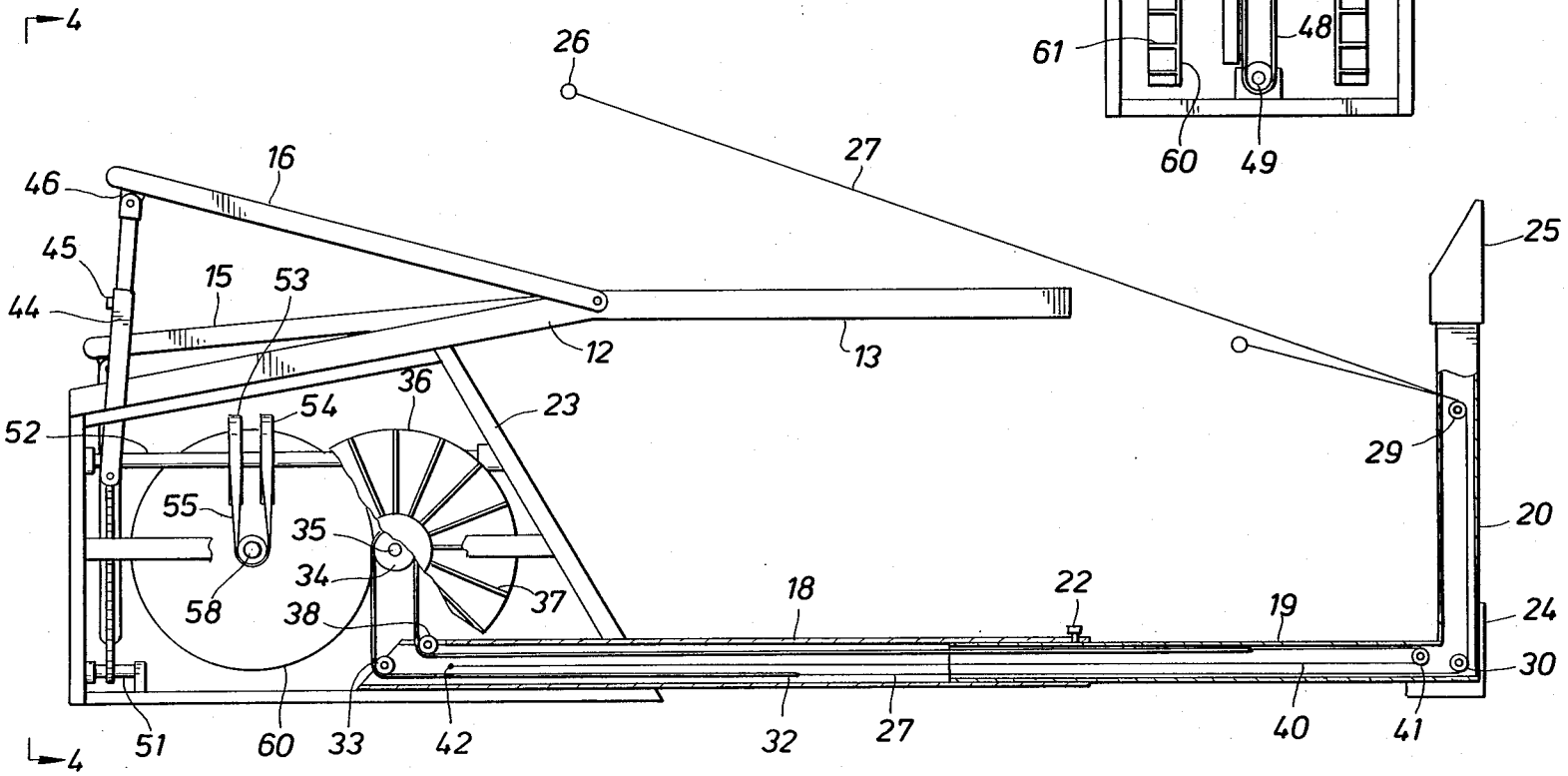

Attention is now directed to FIG. 3 of the drawings for a description of the arm operated system in the preferred form. In FIG. 3 of the drawings, the cowling 11 has been omitted while the various components are supported by a frame 23. The frame includes the necessary structural members to assure that the system has structural integrity and supports the operative components in the positions illustrated. Moreover, the view of FIG. 3 illustrates that the frame 23 extends slightly below the tubular member 18 to support it in a generally horizontal and slightly elevated position. The frame 23 connects with the tubular member to enable telescoping of the forward end of the equipment including the upright 20. The upright 20 is preferably aligned so that it stands vertically, and is supported on a angle 24 to assure an upstanding posture. As desired, a control panel 25 can be mounted on this upright so that it is easily viewed by the user. The control panel 25 is incorporated to provide various speedometers and other meters for convenience of the user. For instance, one helpful device is an elapsed timer which indicates to the user the duration of operation. Another device preferably incorporated at this location for easy viewing by the user is a speedometer. Ideally, two speedometers are used, one connected with the apparatus deriving power from the arms and the other being connected to the power consuming apparatus powered by the legs of the user. Actual power generated can also be displayed. More will be noted concerning this.

Similar to FIG. 2 there are duplicate cabling systems, one for each arm. Only one will be described in view of the fact that they are duplicate. Thus, both FIGS. 2 and 3 show a handle 26 connected with a flexible cord 27. The cord is routed over a sheave 29. The sheave 29 is also shown in FIG. 1 of the drawings. As will be understood, the frame member 20 has an opening so that the cable 27 passes into the opening. The cable is enclosed along its route. Thus the user can operate the cable 27 beyond the point where it emerges from the equipment. The handle 26 is grasped and pulled. The opening is of sufficient size to permit cable response to arm flexure from any type of stroke including a crawl stroke, breast stroke or the like. Such movements on the part of the user deflect the cable but the opening is sufficiently large and sufficiently close to the sheave 29 that cable binding at the opening does not occur.

The cable 27 has a downwardly extending portion which passes over the sheave 30. This enclosed sheave redirects the flexible cable 27 along the hollow tubular members as illustrated. The flexible member 27 terminates at the end of a flat belt 32, the belt 32 passing over a belt pulley 33 at the back end of the tubular member 18. The belt 32 is directed upward to engage a toothed or cogged gear 34. In turn, that connects with a shaft or axle 35 which supports a fly wheel 36. The fly wheel is equipped with suitable impeller blades 37 to create an air disturbance and thereby consume power. The belt 32 is preferably constructed with links, cogs or teeth to enable positive connection to be made with the gear 34. The belt contact with the pulley or gear is a high friction contact or positive engagement to assure that slippage does not occur. The gear 34 is constructed with an overrunning clutch. The overrunning clutch permits power to be applied in one direction, as will be described, yet rotation in the opposite direction is also permitted in a freewheeling fashion. The belt 32 extends around the gear 34 and passes over another sheave 38 to extend along the interior of the tubular member 18. The belt 32 terminates within the tubular member and connects with a flexible resilient return cord 40. That cord engages a sheave 41 and extends parallel to the belt 32 in the tubular member and is anchored at the end point 42.

The cord 40 is flexible and able to elongate. That is, it is made of resilient material while the belt 32 and cable 27 do not elongate. Operation of the system should be considered. Assume in the ordinary swimming stroke that the user reaches forward over the user's head as shown in FIGS. 1 and 2. The handle 26 is gripped or held by the user. On this extended forward stroke, the cable 27 is retrieved out of sight except for that short portion which extends to the user's hand in near proximity. In a crawl stroke, the user begins a power stroke. The user experiences resistance in this downward power stroke. As viewed in FIG. 1, the arm sweeps in an arc downwardly to simulate the power stroke of the crawl. During this, the cable 27 is pulled or etended. This cable 27 passes over the various sheaves as illustrated to connect to the belt 32. The belt 32 is a flat belt as mentioned and passes over the pulley 33. When pulled, it provides a power stroke from the belt 32 through the overrunning clutch to the shaft 35 to thereby rotate that shaft and rotate the fly wheel 36. The length of belt 32 is such that the full extremities of travel experienced by the belt 32 align the belt to maintain alignment on the pulleys 33 and 38 so that the belt properly engages the gear 34. The gear 34 conforms with the belt 32 in that the teeth or cogs of the belt assure positive engagement and rotation. That is, there is no slippage between the belt and the gear 34. As stated before, the belt or chain is either a high frictional engagement or positive engagement flexible member. For a linked chain, a gear with teeth does not slip. For a belt, a pulley frictionally engaging the belt without slippage is used. The terms pulley and gear describe similar devices.

Recall that the last flexible member 40 is resilient. It is resilient to assure that a continual load is applied to the belt to thereby sustain continued connection of the belt with the cogged gear 34. This positive connection assures that resistance loading on the belt 32 occurs without slippage. In other words, slippage is prevented at this contact. By contrast, the other sheaves are primarily idlers and slippage is unimportant at them. It is not important that the resilient member 40 have great resilient strength for recoil; what is important is that sufficient resiliency be obtained in the system to retrieve the cable 27 when the user reduces his pull on the cable. That is, when the hand of the user moves forwardly, the cable 27 is retrieved, and any slack is taken out of the system. This recoil system thus retrieves the cable 27 and resets the apparatus for the next stroke. On the power stroke, the overrunning clutch enables the stroke to apply power to the fly wheel while the return stroke occurs with the overrunning clutch permitting free wheeling relative rotation. The shaft 35 preferably supports the two such overrunning clutches, one on each side of the fly wheel 36. One is for operation by the left hand of the user while the other is powered by the right hand. Duplicate cable systems are included as shown in FIG. 2. They operate in identical fashion. They can be powered simultaneously as in the instance of a butterfly stroke. They may be powered at noncoincident intervals as in the case of simulated crawl strokes. In either case, power is applied through the respective hand powered cabling system through the overrunning clutches and to the shaft.

The fly wheel 36 has a specified diameter and weight. This determines in part the encountered by the user. Blades are included on the exterior to stir the air and thereby create added pneumatic resistance. As speed increases, the turbulence increases even more to thereby provide further retardation. This highly retarded operating state provides a maximum load for the user. The load increase with speed ordinarily. The user is thus able to experience increasing resistance to the various power strokes.

The foregoing describes the power system associated with the arms of the user. This power system transfers or converts simulated swimming strokes of the arms of the user into pulsating rotative power applied to the shaft and then applied to the rotating fly wheel. In general terms, this consumes substantial power from the user depending on scale factors such as size of the fly wheel, the relative diameter of the drive gear 34 and other factors.

DESCRIPTION OF THE LEG POWERED APPARATUS

The foregoing was directed to the arm powered energy consuming system. A similar energy consuming system is included for the legs. However, it receives power in an entirely different fashion. Recall that the user positions both legs on the respective leg supporting platforms shown in FIG. 2. In FIG. 3 of the drawings, the platform 16 is raised to show the upward extent of travel while the platform 15 is at the lower extent of travel. The platform 16 is connected with an adjustable strut 44 which extends approximately downwardly. The strut 44 is made of two pieces which telescope and which fasten together with a lock 45. The strut 44 is thus adjustable in length. It is joined at a clevis 46 beneath the platform 16. The clevis permits pivotal connection. The strut 44 extends downwardly to connect at its lower end with a belt or roller chain 48 which travels between a pair of fixed duplicate pulleys or sprockets 49 and 50. Preferably, the belt has cogs or teeth to avoid slippage of the belt. The belt is connected with the pulley 49 which is an idler pulley supported on a shaft 51 shown in FIG. 3. The shaft 51 is parallel to another shaft 52. The shaft 52 passes through the pulley 50 and is journalled to it. The shaft 52 supports a pair of driven pulleys 53 and 54. The pulleys 53 and 54 engage a belt 55 which extends over the pulleys as shown in FIG. 3. The belt 55 is better shown in FIG. 4 to engage a pair of driven pulleys 56 and 57. The pulleys 56 and 57 are supported on the shaft 58 by means of overrunning clutches. The shaft 58 supports a fly wheel 60, the fly wheel preferably incorporating fan blades at 61.

The two legs of the user drive the two respective struts which connect with the chain 48. Two struts connect with the chain at opposite sides of the pulleys so that downward strokes with power are applied in synchronized movement. The chain is oscillated to and fro. When this occurs, the driving motion is imparted to the fly wheel 60, but it is provided in impulses because the overrunning clutches delivery power on the power stroke of the user. That is, there is a power stroke and there is a return stroke with free wheeling movement. The fly wheel is thus powered with pulsating energy applied from the user. When one leg moves downwardly, a power stroke is applied from that one leg through the chain 48 and ultimately to the fly wheel 16. While that leg is being raised, the opposite leg is forced downwardly to provide the next power stroke which also is imparted to the fly wheel 60. The alternating power strokes assure continuous operation of the fly wheel.

Figure 4:
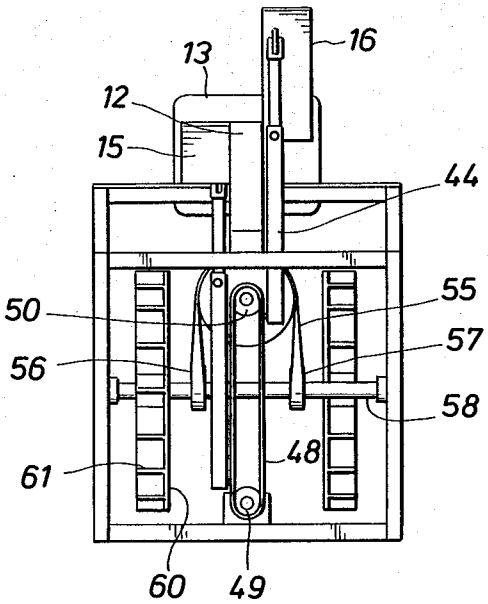

Important features to be noted regarding the arrangement shown in FIGS. 3 and 4 include the ability to change the angle of the legs relative to the trunk of the body. The two struts are adjustable in length. The leg position can thus be raised or lowered depending on adjustments in length of the struts. Once at a selected position, the user need only drive the struts through a stroke controlled by the user. In other words, stroke length is controlled by the user and is variable. The maximum leg elevation is initially set by the user. An important factor is that the fly wheel 60 is driven at a speed which is independent of the power consumption of the fly wheel 36 which is powered by the arms. The two power consuming systems operate independent of one another. The rate at which power is consumed in each is dependent on velocity of the fly wheels. They can be driven more rapidly if the user increases the pace of operation. Moreover, they are driven so that the two fly wheels can provide ventilation to the user. The framework in FIG. 3 is illustrated with the cabinetry removed. Preferably, cabinetry is placed over the working components and with suitable vents arranged in the cabinetry, air flow can be directed upwardly towards the user through the cabinetry. This will ventilate the user through the slots in the cabinet.

AN ALTERNATE EMBODIMENT

Attention is now directed to FIG. 1 of the drawings which a slightly simplified construction in contrast with that of FIG. 3. In FIG. 1 of the drawings, the user pulls on the cable 27 which is routed over appropriate sheaves to align in the tubular member 18. The cable 27 again connects with a flat belt drive, in this embodiment identified as the belt 66 which passes over an idler sheave 67. In turn, it drives a mating toothed or cogged gear 68 connected by an overrunning clutch to a supportive shaft 70. This rotates the fly wheel 71. The flat belt 66 is routed again into the tubular member in the same fashion as the embodiment shown in FIG. 3. It connects to a flexible and resilient member for retraction in the same fashion as the prior embodiment. This particular embodiment is simplified in that the flexible cable is routed in a simpler fashion. Moreover, duplicate cables are again provided, one for the left hand and one for the right hand, and they drive duplicate overrunning clutches on opposite sides of the fly wheel 71. In turn, they provide power impulses to the shaft 70 for rotation of the fly wheel.

Attention is next directed to FIG. 5 of the drawings which shows an isometric view of the leg powered power dissipating system which is identified generally by the numeral 80. Briefly, this system utilizes the endless chain illustrated in FIG. 4 which is driven by a pair of leg powered struts 81 and 82 thereabove. The chain 83 connects to appropriate spaced gears to rotate a shaft 84. The shaft 84 is powered by the chain 83 rotates drive pulleys 85 and 86 which in turn reciprocate an endless belt 87. The belt 87 is connected to a mounting shaft 88 through gears 89. Overrunning clutches are incorporated at the pulleys 85 and 86 to permit the fly wheel to be driven in one direction by the pulsating power from the user.

FIG. 6 shows another alternate view of the arm powered energy dissipating system 90. There, a flexible belt 91 passing over an idler 92 is pulled to and fro by the arm strokes. The belt 91 extends to a pulley 93 mounted on an overrunning clutch supported on a shaft 94. The belt is connected with a resilient member 95 which is anchored at a remote location to thereby provide retraction to the belt 91. The shaft 94 is rotated and in turn rotates the fly wheel 96.

The alternate illustrations of components shown at 80 and 90 can be implemented in a modified arrangement of the housing and other apparatus within the equipment. That is, the cabinetry which surrounds the exterior plus the supportive framework can be varied as suggested by these alternative embodiments.

An important feature of the present apparatus is the ability to collapse the system so that it stores as a smaller structure. In particular, FIGS. 1 and 3 shown how the structure can be shortened by significant length from approximately nine or ten feet in length to about six feet or less. This markedly reduces the floor space which is required for storage of the apparatus.

The equipment is preferably formed of relatively light weight structural tubing in the preferred embodiment, aluminum having preferred so that the relative weight of the structure is light. The framework is preferably made of similar structural material. Suitable padding is placed on the surfaces contacted by the user so that personal comfort is obtained by this arrangement.

The apparatus also incorporates suitable indicators for the user including an elapsed time device, speedometers connected to the two fly wheels, and a power measurement system. This equipment is physically placed where the user can see the indications provided by the equipment.

While the foregoing is directed to the preferred embodiment, the scope is determined by the claims which follow.

I claim:

1. An exercise device wherein the user simulates swimming with a variety of swimming strokes, comprising:

(a) a base;

(b) body support means above said base for supporting the body of a user in a generally horizontal position thereon;

(c) power consuming means;

(d) separate left and right independent arm powered means adapted to be engaged by a user with left and right arms for independent arm strokes applied thereto wherein said arm powered means provides arm generated power to said power consuming means;

(e) pivotal separate left and right leg powered means powered by left and right legs of a user wherein leg strokes of the user provide power to said power consuming means; and (f) wherein said power consuming means comprises independent arm and leg powered fly wheels respectively connected with said arm and leg powered means.

2. The apparatus of claim 1 wherein said base includes a frame, a surrounding cowling and an extending member terminating beyond the user in a prone position.

3. The apparatus of claim 2 wherein said extending member is adjustable in length for length reduction for storage.

4. The apparatus of claim 1 including separate flexible cable means connected to said arm powered means, wherein said body support means positions a user to reach overhead and independently power said separate flexible cable means connected to said arm powered means.

5. The apparatus of claim 1 wherein said arm powered means comprise left and right flexible cable means operatively connected to said power consuming means to operate an arm powered means.

6. The apparatus of claim 5 including driven means for engagement with said cable means, wherein said cable means are elongate flexible cables having portions thereof positively engaged with said driven means to prevent slippage.

7. The apparatus of claim 6 wherein said driven means comprises a gear engaging overrunning clutch means to rotate said fly wheels.

8. The apparatus of claim 7 including first and second overrunning clutches, one each for said left and right cable means.

9. The apparatus of claim 6 wherein said elongate flexible cables have an end portion which is flexible, an intermediate flexible toothed portion and an anchored flexible and extendable portion, wherein said end portion connects with handle means for user engagement and said toothed portion is guided into positive engagement with said power consuming means by a mating toothed gear.

10. The apparatus of claim 1 wherein said fly wheels are mounted on separate mounting shafts.

11. The apparatus of claim 10 wherein said shafts are located within an enclosed housing positioning said shafts and fly wheels within the closed housing.

12. The apparatus of claim 1 wherein said arm powered means includes elongate cable means routed for hand use and extend into and along an extendable tubular member connected to said base.

13. The apparatus of claim 12 wherein said tubular member includes first and second telescoping portions enabling said base to telescope into a shortened storage length and also into a longer length for use.

14. The apparatus of claim 13 wherein said tubular member comprises:

(a) first horizontal hollow member;

(b) second horizontal hollow member;

(c) lock means joining said first and second horizontal members together in a fixed relationship;

(d) an upright hollow member having an opening therein to receive said elongate cable means therein, said upright hollow member routing said cable means along said first and second horizontal members to opertively connect with said power consuming means.

15. An exercise device wherein the user simulates swimming with a scissor kick, comprising:

(a) horizontal support means for extending beneath a swimmer performing a scissor kick;

(b) left and right leg supports;

(c) pivotal mounting means for mounting said leg supports for repetitive leg driven movement by a user simulating a scissor kick from a horizontal position on said support means;

(d) adjustable left and right leg flywheel actuation means for initially setting the angle of the user's legs relative to the trunk of the user's body, said flywheel activation means driven by said left and right leg supports in repetitive motion;

(e) power consuming means responsive to said flywheel actuation means for consuming power from the legs of the user wherein said power consuming means responds to leg kick strokes of any length in a given range.

16. The apparatus of claim 15 wherein said power consuming means includes an endless belt in looped configuration driving a fly wheel through an overrunning clutch, said belt and said connectors being joined by left and right connector means enabling reciprocating means.

17. The apparatus of claim 15 including means connected to said connectors and to said power consuming means for enabling rotation of a fly wheel driven by leg kick strokes of varied length and having continuous power transfer thereto through an overrunning clutch.

* * * * *